US005843030A

United States Patent [19]

Van Der Merwe

[11] Patent Number: 5,843,030

[45] Date of Patent: Dec. 1, 1998

[54] DEVICE

[75] Inventor: Marius Van Der Merwe, Stellenbosch, South Africa

[73] Assignee: Harwill Industries (Pty) Limited, Durbanville, South Africa

[21] Appl. No.: 629,633

[22] Filed: Apr. 9, 1996

[30] Foreign Application Priority Data

Feb. 7, 1996 [GB] United Kingdom ..... 9602507

[51] Int. Cl.[6] ..... A61J 17/00

[52] U.S. Cl. ..... 604/77; 606/236

[58] Field of Search ..... 604/77, 73, 56; 606/236, 235, 234

[56] References Cited

U.S. PATENT DOCUMENTS

| | | | |
|---|---|---|---|
| 4,821,895 | 4/1989 | Roskilly | 215/11.1 |
| 5,029,701 | 7/1991 | Roth et al. | 206/232 |
| 5,244,122 | 9/1993 | Botts | 604/77 X |
| 5,383,906 | 1/1995 | Burchett et al. | 606/236 |
| 5,554,116 | 9/1996 | Fu-Hsiang | 604/77 |

FOREIGN PATENT DOCUMENTS

| | | |
|---|---|---|
| 0681824 | 11/1995 | European Pat. Off. . |
| 8714078 | 10/1987 | Germany . |
| 9006946 | 6/1990 | Germany . |
| 9309796 | 6/1993 | Germany . |

*Primary Examiner*—John D. Yasko
*Attorney, Agent, or Firm*—Jefferson Perkins

[57] ABSTRACT

The present invention relates to a device for administering a fluid medicament to an infant via a teat in fluid flow communication with a reservoir for the fluid medicament, characterised in that the device comprises:

a. a teat having an inlet at or adjacent its proximal end to receive fluid from the reservoir and an outlet at or adjacent its distal end through which fluid fed to the teat from the reservoir is adapted to flow into the mouth of a user;

b. a conduit within the teat directly connecting the said inlet to the said outlet for the direct flow of fluid medicament from the reservoir to the outlet of the teat;

c. an intermediate member located intermediate the proximal end of the teat and the reservoir and adapted to securely receive and locate the teat and to receive the reservoir;

d. a reservoir formed integrally with, or demountably secured to, the said intermediate member and being in fluid flow communication via said intermediate member and said conduit with said teat outlet.

Preferably, the device also comprises means for generating a positive pressure within the reservoir to assist discharge of fluid from the reservoir to the teat outlet.

The invention also provides a method for administering a fluid medicament using a device of the invention.

8 Claims, 7 Drawing Sheets

17
17
61
60
63
16
51
12
10
13
3
2
6
9
9
1
8
1c
1c
7
8
9
9
1

61
60
51
12
15
57
10
4
5
6
2
14
3
1
7

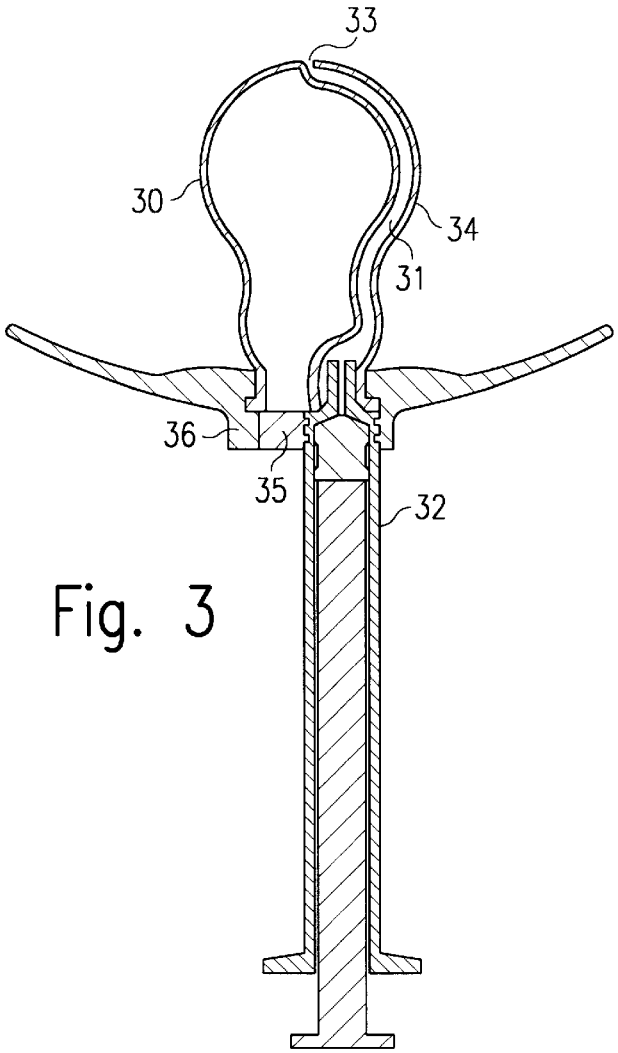
Fig. 3
Fig. 3b
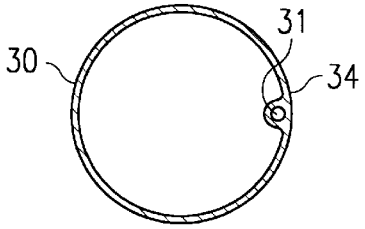
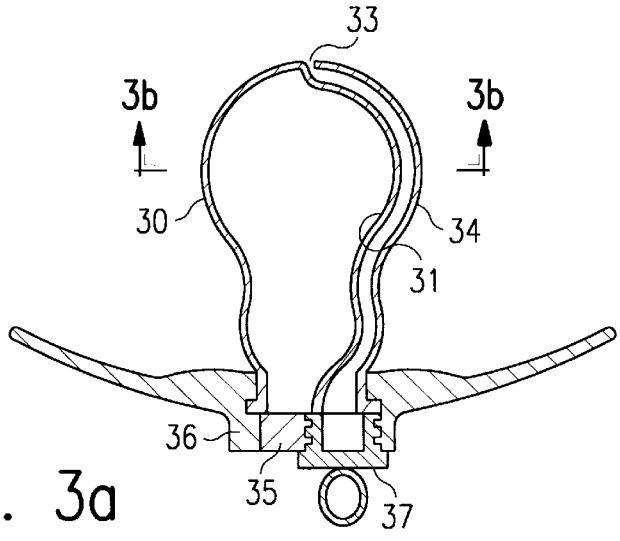
Fig. 3a

DEVICE

The present invention relates to a device, notably to a device for administering a medicament to a baby or infant.

BACKGROUND TO THE INVENTION

When it is desired to administer a medicament to a baby, infant or young child, collectively hereinafter denoted as infants, problems are encountered in persuading the infant to accept the medicament. One problem is the unpalatable taste or consistency of many medicaments. It has therefore become common practice to put medicaments up in syrup or fluid formulations which have a palatable taste and are easily ingested as fluids. However, particular problems arise with very young or infirm children who reject fluids when offered to them in a spoon or other conventional methods of administration. It has been proposed to fit a comforter teat onto the distal end of a conventional syringe. However, such a device is not visually acceptable to the infant and problems are encountered with premature detachment of the teat from the syringe resulting in spillage of the medicament and the risk of ingestion of the loose teat by the infant.

It has also been proposed in European Patent Application No 0681824 A1 to administer medicaments via a conventional infant's comforter teat so as to provide an administration device which is acceptable to the infant. The comforter comprises a conventional hollow teat having a medicament reservoir attached thereto and in fluid flow communication with the teat. The reservoir is charged with the required dose of medicament and the infant acquires the medicament by sucking on the teat in the normal manner of an infant seeking comfort through the suckling action. In order to regulate the flow of medicament to the infant, it is stated to be essential to provide a valve or flow control means in the flow path between the reservoir and the interior of the teat. In this way, the flow of a concentrated medicament can be regulated so as to avoid excessive concentration of medicament in the mouth of the infant or to provide a prolonged period of administration of the medicament. It is thus possible to avoid the need to refill the reservoir repeatedly with dilute medicament where a large total dose of a potent medicament is required.

However, we have found that such a device is complex and requires accurate manufacture if the medicament is to be administered correctly and this introduces costs and complexity in the design and manufacture of the device. Furthermore, such a device suffers from contamination and dilution of the medicament in the teat or reservoir where the infant has a weak sucking action, which may allow saliva or diluted medicament from the infant's mouth to be drawn back into the teat and reservoir; or where the infant loses interest in the comforter and removes it from its mouth, external contamination can enter the teat or reservoir. Furthermore, residual sweetened medicament in the body of the hollow teat can provide a medium for bacterial growth or a continuing source of sugar which can cause dental caries.

Surprisingly, we have found that these problems can be reduced if the flow communication between the reservoir and the outlet to the teat is kept to a minimal volume, so that medicament enters the ing=fant's mouth with the minimum of delay. The problems of saliva or dirt contamination are further reduced if a positive pressure is applied to the medicament reservoir so as positively to discharge of the fluid medicament from the reservoir to the mouth of the infant through the teat. The positive pressure can be generated by a syringe or other pump means operated by a parent or other operator administering the medicament to the infant. In such a case, the medicament is administered over a controlled time period under the direct supervision of the operator who can verify that the whole dose of the medicament has been delivered and that any discomfort due to excessive rate of application and/or excessive concentration of medicament is minimised. The use of a fine bore fluid communication between the reservoir and the teat outlet also minimises the risk of contamination of the medicament when the infant discards or rejects the teat. The syringe or pump means can be formed so that it is demountably secured to the comforter assembly so as to permit cleansing of the device for reuse. Alternatively, other means can be provided for generating a positive pressure within the medicament reservoir which are formed integrally with the reservoir.

Such forms of the device of the invention enable the operator to insert the teat into the infant's mouth and allow the infant to depart beyond the operator's immediate area of supervision. Due to the positive pressure applied to the medicament, the medicament rapidly flows from the reservoir to the teat and thence is ingested by the sucking action of the infant. Since the medicament is rapidly administered to the infant, the risk of only partial administration of the dose of medicament is reduced. We have found that an infant actively sucks upon the teat during the initial period following insertion of the teat into the infant's mouth and the rapid discharge of the medicament to the teat takes advantage of this to achieve complete and rapid administration of the medicament. Furthermore, by applying a positive pressure to the reservoir during the administration of the medicament, the risk of back flow of saliva into the reservoir and contamination of the medicament is reduced.

SUMMARY OF THE INVENTION

Accordingly, the present invention provides a device for administering a fluid medicament to an infant via a teat in fluid flow communication with a reservoir for the fluid medicament, characterised in that the device comprises:

a. a teat having an inlet at or adjacent its proximal end to receive fluid from the reservoir and and outlet at or adjacent its distal end through which fluid fed to the teat from the reservoir is adapted to flow into the mouth of a user;

b. a conduit within the teat directly connecting the said inlet to the said outlet for the direct flow of fluid medicament from the reservoir to the outlet of the teat;

c. an intermediate member located intermediate the proximal end of the teat and the reservoir and adapted to securely receive and locate the teat and to receive the reservoir;

d. a reservoir formed integrally with, or demountably secured to, the said intermediate member and being in fluid flow communication via said intermediate member and said conduit with said teat outlet.

Preferably, the device also comprises means for generating a positive pressure within the reservoir to assist discharge of fluid from the reservoir to the teat outlet.

Preferably, the teat comprises a conventional comforter teat having one or more fluid flow passages or conduits therein adapted to receive fluid from the reservoir and to conduct it to the mouth of an infant into which the teat has been inserted. The teat can be a solid body with one or more bores formed therein to conduct fluid medicament from the reservoir to the mouth of the infant. Typically, there will be a single outlet orifice from the teat and this will be connected by one bore to the reservoir. If desired, the teat can be formed with one or more large diameter portions to that bore which portions have flexible wall sections which flex under the sucking action of the infant to increase the rate of flow of fluid from the reservoir to the teat outlet. If desired, the bore can incorporate a one way flow mechanism to minimise the return flow of saliva and medicament to the reservoir from the teat outlet.

However, it is preferred that the teat be a hollow body which can deform as the infant sucks upon it in the manner of a conventional comforter teat. Such a teat is provided with one or more passages or conduits for the transport of fluid through the length of the teat from its inlet to its outlet. Such conduits can take the form of rigid or flexiable tubes formed within the teat which extend directly between the inlet and outlet of the teat. Such conduits extend across the internal space of the bulb of the teat and usually require a measure of mechanical support, for example by means of webs or ribs extending laterally from the wall of the conduit to the internal surface of the outer wall of the teat. Alternatively, such a conduit can be formed in or adjacent the outer wall of the teat.

The conduit, passageway or bore extends from the inlet to the outlet of the teat, preferably by the most direct route and serves to place the reservoir in fluid flow communication with the teat outlet by a route which has a small fluid volume. By reducing the fluid volume retained within the teat, problems due to contamination of the medicament in the reservoir due to inflow of saliva if the device is removed from the mouth of the infant or if the infant has an intermittent or poor suck, are reduced. The use of a small volume conduit between the reservoir and the teat outlet also serves to minimise any reduction in suction on the reservoir as the infant sucks on the teat, thus aiding discharge of fluid from the reservoir. It is preferred to design the conduit, passageway or bore so that it has a volume less than 10% of the corresponding hollow teat.

The teat is mounted upon the intermediate member which provides a secure mounting for the teat and the reservoir and is also provided with a conduit or bore therein to place the reservoir in fluid flow communication with the inlet to the teat. Preferably, the intermediate member comprises a radially extending flange which prevents ingestion of the device. The proximal end of the teat or a member carrying the teat is a snap, clamped or other fit upon the intermediate member so as to minimise the risk of accidental removal of the teat during use, yet permitting removal of the teat by an operator for cleaning or replacement. The teat can also be mounted by way of a screw, bayonet or other mounting which resists removal of the teat by the sucking action of the infant and which requires the operator to carry out some positive action not normally associated with the administration of the medicament to dis-assemble the teat from the intermediate member.

In one embodiment of the invention, the teat is secured to the intermediate member and the intermediate member is provided with a mounting cup or the like in its proximal face or end (that is the end removed from the free end of the teat which enters the mouth of the infant, which end will be denoted herein as the distal end of the teat). The distal end of a syringe or other means for generating a positive pressure on the fluid medicament is removably mounted to the intermediate member by said cup. Preferably, the syringe body provides the reservoir for the medicament and the piston and plunger of the syringe provide the pump means for generating the positive pressure within the reservoir. The distal end of the syringe is provided with a screw, bayonet or other positive action mounting means by which it can be secured to the cup of the intermediate member.

Whilst such a form of the device of the invention provides a simple and effective means for administering a medicament to an infant, the device presents an unfamiliar profile to the infant, which may cause distress and rejection of the device. In an alternative embodiment of the invention, the reservoir is formed integrally with the intermediate member and incorporates a pump or other means for generating a positive pressure within the reservoir. Such a device can be formed so as to resemble a conventional comforter and hence will be psychologically more acceptable to the infant.

Preferably, the device of the invention comprises a conventional comforter body shaped intermediate member having the teat mounted distally thereon and having one or more radial flanges to prevent ingestion of the body of the comforter by the infant. Proximally of the flange is located the reservoir which is preferably of a generally cylindrical form so that the device possesses radial symmetry about its longitudinal axis. The reservoir preferably has a capacity of from 1 to 15 mls, preferably 5 to 10 mls.

The reservoir is preferably provided with means for generating a positive pressure within the reservoir. This can be achieved by forming the reservoir as a distendable rubber or similar bulb which is distended when charged under pressure with medicament. Alternatively, a wall of the reservoir can be formed as a deformable elastic wall, for example as a diaphragm or bellows section wall, so that the wall can be distended upon charging the reservoir with the required dose of medicament. The distended bulb or wall applies a positive pressure to the fluid within the reservoir which causes the medicament to discharge via the bore or conduit in the teat rapidly and with a minimum of fluid volume in the conduit or bore to the teat outlet. If desired, the deformable wall can be tensioned or pre-stressed in its rest configuration so that a positive pressure is maintained upon the medicament throughout its discharge. If desired, such a deformable structure can be housed within a rigid outer housing to protect the deformable components against external pressure and/or damage.

Alternatively, the positive pressure can be generated by a spring or other biassed member which bears against a piston or deformable wall of the reservoir to decrease the internal volume of the reservoir and thus apply positive pressure on the medicament in the reservoir. The positive pressure is preferably generated by a spring loaded piston which slides in sealing engagement with the walls of a cylindrical bore or which bears against a transverse deformable diaphragm wall of such a bore. The piston can have an axial extension by which it is grasped by a user to retract the piston against the spring or other bias. This action can be used to draw fluid medicament into the reservoir in the same manner as the charging of a syringe by retraction of the piston in the bore thereof. Upon release of the axial extension, the piston moves axially under the influence of the bias to discharge the medicament from the cylindrical bore. If desired, the shank of the axial extension can incorporate latch means, for example radially acting teeth, which engage with a stop means to retain the extension in its retracted position. Such a latch can act as a ratchet and prevent return of the plunger or piuston if a positive pressure is applied at the teat outlet, for example if the infant bites on the teat. When the teat is inserted into the infant's mouth, the latch can be released so that the piston generates the pressure for discharge of the medicament. If desired, as second latch can be provided which engages when the piston reaches the extreme of its discharge stroke, so as to prevent accidental retraction of the piston whilst the device is in the mouth of the infant.

Alternatively, where the reservoir is not provided with means for generating a positive pressure, for example the piston is not provided with bias means, the medicament is drawn from the reservoir by the sucking action of the infant. Where the direct flow communication between the teat outlet and the reservoir is not achieved, for example where a conventional hollow teat is used, the suction effect upon the reservoir is reduced or lost and the reservoir does not empty adequately. With the direct flow communication such loss of suction effect is minimised and the sucking action of the infant will usually substantially empty the fluid from the reservoir. However, where the infant has a poor sucking action or discards the device before the requiored dose of medicament has been administered, a user can depress the axial extension to the piston plunger to apply a discharge pressure to the medicament and/or to ensure that any fluid remaining in the reservoir is discharged.

As indicated above, the device of the invention can be formed with the reservoir and pump components demountable from the teat/intermdiate member components of the device. However, it is preferred to form the device as a unitary construction with the reservoir and pump means formed integrally with other components. In order that the device should be capable of cleaning after use, it is preferred to form the various components as snap, screw, bayonet or push fit engagement with one another. In a particularly preferred construction, the reservoir is formed as a component which carries the pump mechanism integrally therewith, and which is pivotally or otherwise mounted on the proximal portion of the intermediate member so that it can be detached or pivoted to expose the interior of the reservoir for charging with the fluid medicament.

The device of the invention can readily be made as a number of inter-engaging plastic components each formed by a moulding or extrusion process. Such components can readily be dis-assembled for cleaning and sterilization. Where the reservoir is formed integrally with the comforter body component, the device presents a substantially closed unit after the medicament has been administered so that accidental contamination of the reservoir is minimised in the event of the device being discarded by the infant. Where a demountable syringe provides the reservoir and pump means, this will usually be detached by the operator from the comforter body member after administration of the medicament, exposing the syringe mounting socket or recess to accidental contamination. It is therefore preferred to provide a cap member which can be applied to such a socket or recess to minimise ingress or dirt or other contamination.

In use, the reservoir is charged with the desired dose of fluid medicament, the teat of the device is inserted into the mouth of the infant. The suction generated by the sucking action of the infant, coupled with the direct connection of the teat outlet to the reservoir, applies suction to the reservoir and draws the fluid medicament into the mouth of the infant. Where a positive pressure is applied to the reservoir, this will assist discharge of the medicament through the bore(s) in the teat and intermediate member into the mouth of the infant. The pressure applied to the reservoir will, typically, be of the order of 0.05 to 0.5 bar and will depend upon the dimensions of the device and the viscosity of the medicament. Preferably, the pressure applied is the minimum required to cause the medicament to flow to the teat outlet so that the flow of medicament out of the teat outlet orifice does not exceed that which can be ingested by the infant. Typically, the rate of flow should be from 0.01 to 5 mls per second. Where the positive pressure is applied to the reservoir by a spring loaded piston, a distended bulb or wall, and no latch means are provided for retaining the wall or spring in its distended configuration, it is preferred that the pressure applied by the piston, wall or bulb is less than that required to initiate flow of medicament through the teat outlet. In this way, the surface tension forces at the teat outlet prevent escape of the fluid medicament until a reduced pressure is applied from the outflow side of the orifice by the sucking action of the infant. This overcomes the surface tension effects and allows the medicament to flow through the teat outlet.

Once the desired dose of medicament has been administered to the infant, the device can be removed from the infant's mouth. Alternatively, where the device is of unitary construction, the device can remain in place and serve as a conventional comforter until it is necessary to administer another dose of medicament. Where the device is discarded by the infant, for example due to boredom or a poor sucking action, the risk of contamination of the reservoir is reduced. Where the infant ceases sucking for any reason during the administration of the medicament, the positive pressure in the reservoir prevents saliva backflow into the reservoir.

DESCRIPTION OF THE DRAWINGS

A preferred form of the device will now be described by way of illustration and with respect to the accompanying drawings in which FIGS. 2 and 3 show alternative forms of the device of FIG. 1; FIG. 3*a* is a view of the invention corresponding to FIG. 3, showing the insertion of cap 37 in the place of a syringe 32; FIG. 3*b* is a sectional view taken from substantially along line 3*b*—3*b*.

DESCRIPTION OF THE PREFERRED EMBODIMENTS

Figures 1A, 1B, 1C:
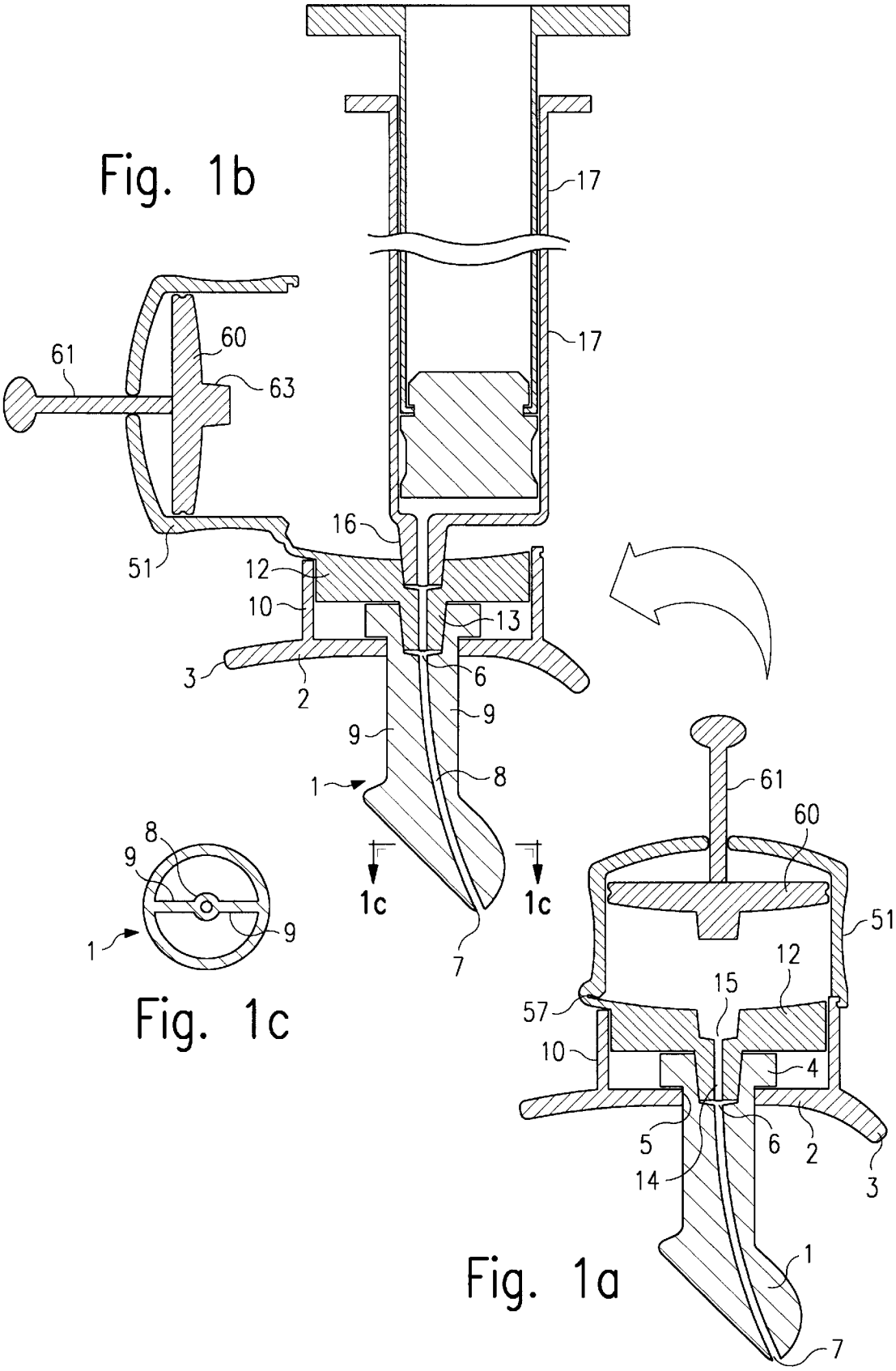
FIG. 1*a* shows one form of the device of the invention with a syringe acting as the reservoir and means for generating positive pressure.
FIG. 1*b* is an axial sectional view of the device shown in FIG. 1*a*, as shown coupled to a medicament syringe.
FIG. 1*c* is a sectional view taken substantially along line 1*c*—1*c* of FIG. 1*b*.

The device of FIG. 1 comprises a conventional comforter body member having a hollow rubber teat 1 secured to one face of a body hub 2. Extending radially from hub 2 is a flange 3 which has a larger diameter than the open mouth of an average infant and serves to prevent ingestion of the device by the infant and to locate the teat in register with the tongue of the infant when the flange 3 bears against the lips of the infant so as to optimise the sucking effect of the infant upon the teat.

Teat 1 has a radial shoulder 4 which seats against the rim of an aperture 5 in hub 2 so as to locate the proximal end of the teat 1 upon hub 2. The teat 1 an inlet orifice 6 at its proximal end and an outlet orifice 7 at its distal end through which fluid can flow from the reservoir to the mouth of the infant during sucking. As shown, the inlet is connected to the outlet by a tube 8 which is supported by webs 9 extending radially from the tube to the adjacent side wall of the teat. The tube 8 has an internal diameter of from 0.25 to 1 mm and provides a direct flow path between the reservoir and the mouth of the infant.

Figure 4:
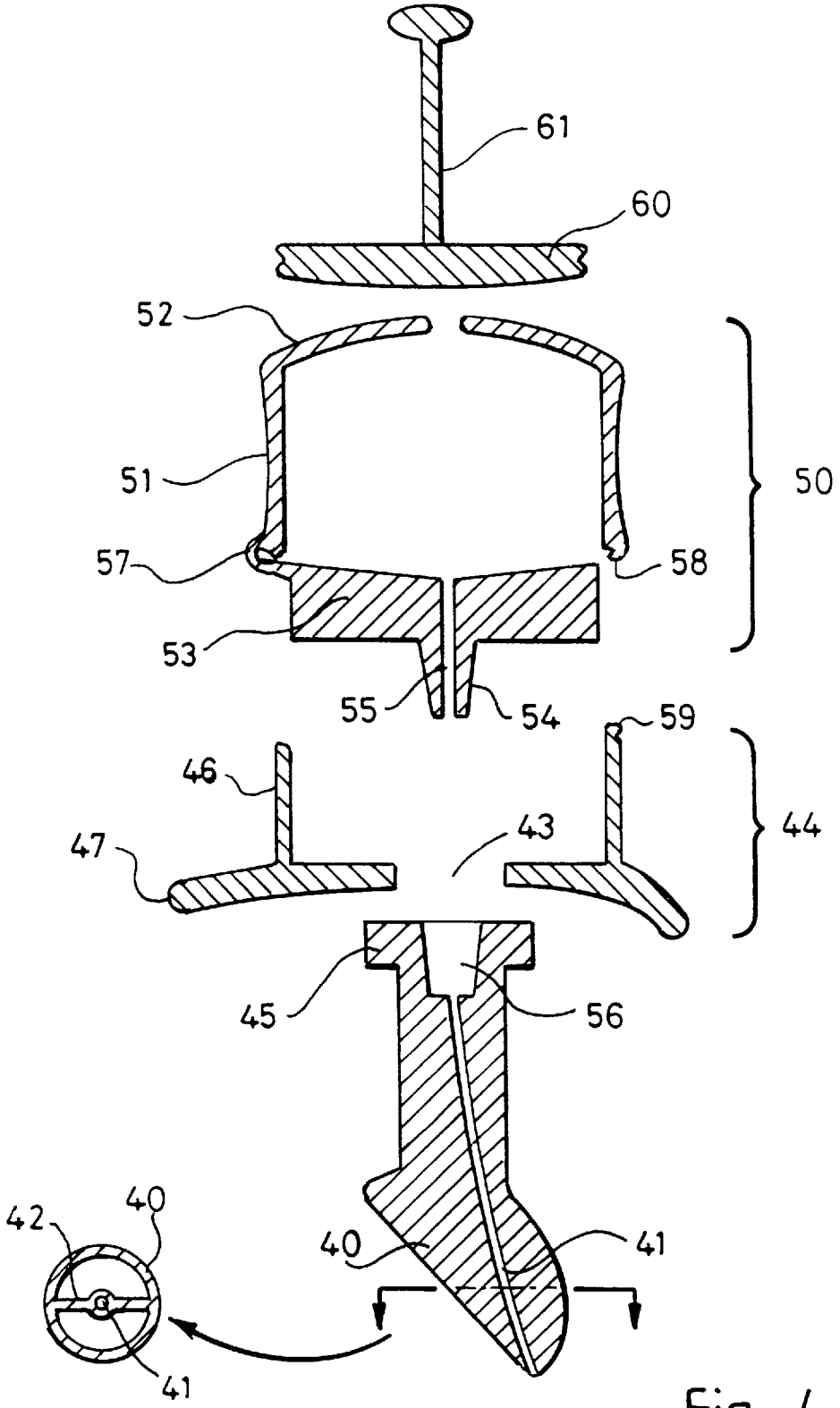
FIG. 4 shows a form of the device where the reservoir is formed integrally with the body of the comforter.

The proximal side of hub 2 carries an upstanding annular skirt 10, upon which may be located a reservoir 51 described in greater detail with resepct to the device of FIG. 4. A retaining member 12 is a snap or other fit within skirt 10 and traps shoulder 4 of the proximal end of teat 1 against the hub 2. Preferably, member 12 has an axial projection 13 which locates in a corresponding recess in the proximal end of teat 1 and serves to locate teat 1, member 13 and hub 2 in register with one another. Member 13 has an axial bore 14 therethrough which forms an extension of the tube 8.

The distal face of member 13 carries a recess 15 in register with the bore 14 which is configured to receive the luer fitting 16 of a syringe 17. The recess 15 and luer 16 can carry co-operating screw thread, bayonet or other fitting (not shown) to secure the syringe luer in recess 15. Syringe 17 has a piston journalled in the bore of the syringe which can apply fluid medicament under pressure via bore 14 and tube 8 to the outlet 7 of teat 1.

In use, the syringe 17 is charged with a fluid medicament in the conventional manner. The luer 16 at the distal end of the syringe is then secured to hub 2 by means of engagement of the luer fitting in recess 15. The distal end of teat 1 is inserted into the mouth of the infant to whom the medicament is to be administered and the plunger of the syringe depressed to discharge the medicament into the mouth of the infant via bore 14 and tube 8 within the teat 1. Due to the spontaneous sucking action of the infant on teat 1, the medicament is ingested by the infant as it is discharged from the teat. Due to the positive pressure exerted by the operation of the syringe, discharge of the medicament into the mouth of the infant is ensured with little or no risk of suck back of saliva into the teat. The operator can monitor the rate of discharge of medicament from the syringe to ensure that the rate is not greater than the infant can ingest and that complete discharge of the medicament into the teat occurs. Due to the direct communication between syringe 17 and the outlet 7 of the teat via bore 14 and tube 8, the volume of medicament in transit between the syringe and the mouth of the infant is kept to a minimum and the risk of contamination of the medicament or loss of medicament due to incomplete administration of what is discharged from the syringe is minimised.

After discharge of the medicament from the syringe, the syringe can be separated from the hub 2 and a conventional comforter ring on a cap can be fitted to recess 15 in place of the syringe 17. The cap provides a closure to recess 15, bore 14 and tube 8 and protects the infant against ingestion of stray material through the teat 1, allowing the used device to remain in the mouth of the infant and act as a conventional comforter. Alternatively, where the hub 2 carries a reservoir 51 of the type described in FIG. 4, the reservoir can be closed to protect the infant and the device used as a conventional comforter.

The teat 1 can be formed as a solid body with the tube 8 formed as a bore within the solid teat.

Figure 2:
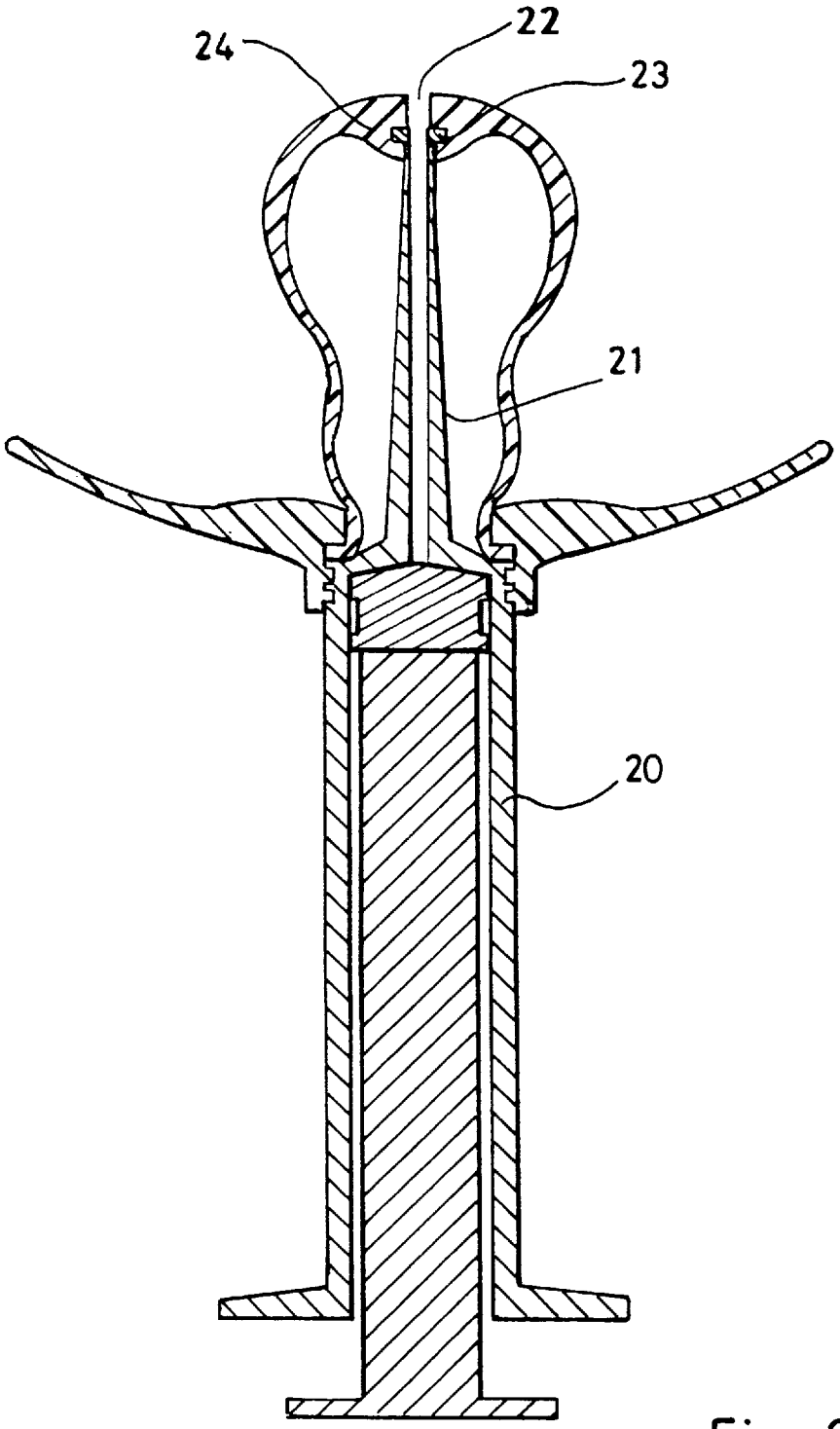

In the alternative form of the device of FIG. 1 shown in FIG. 2, the distal end of the syringe 20 is axially extended to form a spigot 21 which extends to the outlet 22 of the teat and has radial ribs or the like 23 which are a snap fit into corresponding recesses in the distal end 24 of the teat. The spigot 21 acts in place of the tube 8 to form the direct fluid communication between the syringe and the outlet of the teat and transports the fluid medicament directly to the teat outlet 22.

In the alternative form of the device shown in FIG. 3, the teat 30 has an internal duct 31 formed within it to transport fluid from the syringe 32 to the teat outlet 33. In this case, the duct 31 is formed adjacent an outer wall 34 of the teat 30 and the syringe 32 is mounted in a cup 35 located off centre in the hub 36. During sucking on the teat 30, the infant may cause flexing of the outer wall 34 which will assist flow of fluid through the duct 31. After the syringe has been discharged and removed from hub 36, a cap 37 can be fitted to cup 35 to minimise contamination of any residual medicament in duct 31.

In the form of device shown in FIG. 4, the reservoir for the fluid medicament is formed integrally with the remainder of the device. Such a device comprises a teat member 40, having an axial tube 41 therethrough supported by radial webs 42 extending to the inner walls of the teat as shown in the sectional view. The teat 40 locates in an aperture 43 in a hub member 44 and is retained by radial shoulder 45 at the proximal end of the teat 40 bearing against the proximal face of hub 44. Hub 44 has an upstanding annular skirt 46 and a radially extending flange 47.

Figure 8:
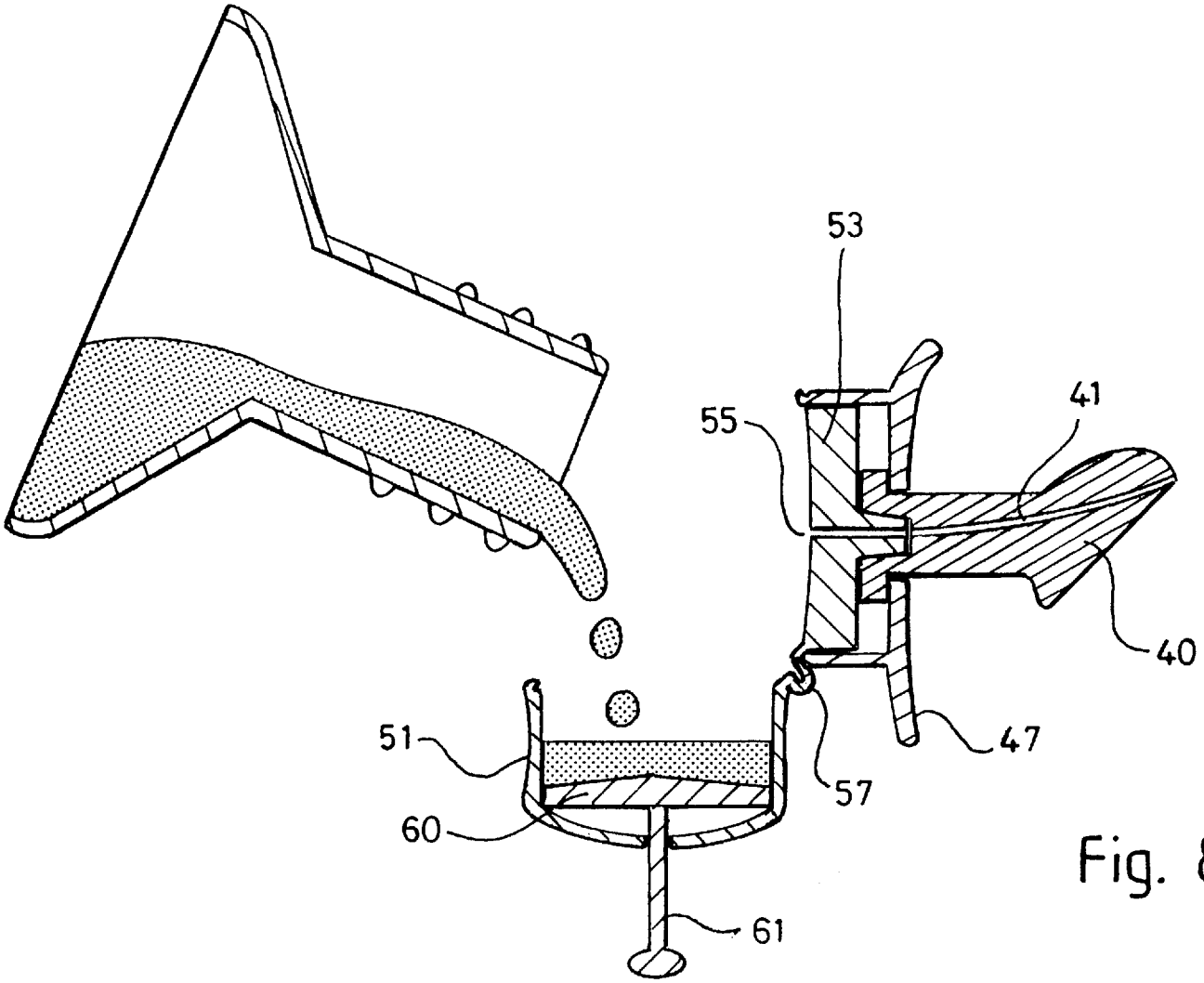

The reservoir member 50 engages with skirt 46 and comprises a generally circular cross-section hollow body member 51 having its distal end open and its proximal end closed by transverse wall 52. Body member 51 can be a push, screw or other fit within or upon skirt 46 so that the enclosed spaced defined by body 51 and skirt 46 forms the reservoir 50. However, it is preferred to provided a mounting member 53 which locates as a push fit within skirt 46. Member 53 has an axially extending spigot 54 surrounding an axial bore 55 which registers with and engages a corresponding socket 56 in teat 40 which is located at the proximal end of bore 41 in the teat 40. Member 53 also traps shoulder 45 against the proximal face of hub 44 to retain teat 40 in position upon the hub 44. Member 53 carries the hollow body 51 thereon. Preferably, as shown, the body 51 is connected to member 53 by a pivot or hinge 57 and body 51 carries a circumferential latch member 58 which engages with a circumferential groove or catch 59 on skirt 46. Body 51 can thus be pivoted about hinge 57 between an open position at which the internal cavity of the body is exposed as shown in FIGS. 1 and 8 to a closed position as shown in FIGS. 1 and 5 in which the latch and catch engage to retain body 51 upon skirt 46 with member 53 bearing against shoulder 45 to retain teat 40 in position upon hub 44.

Within body 51 is slidably journalled an axially moveable piston 60 which carries an axially extending plunger 61 which protrudes through transverse end wall terminal end 52 at the proximal end of body 51. A user can use the exposed end of plunger 61 either to retract the piston 60 in member 51 or to extend piston 60 to apply pressure to any fluid in member 51. Preferably, member 51 and piston is 60 are formed so that the application of suction as the infant sucks on the teat draws sufficient vacuum on member 51 to move piston 60 axially in member 51 to follow the removal of fluid from member 51. The position of plunger 61 thus provides the user with an indication of how much fluid has been withdrawn by the infant from member 51. If necessary, the user can depress plunger 61 to assist discharge of fluid from member 51 into the mouth of the infant.

In the form of device shown in FIG. 1, piston 60 carries an axial protrusion 63 which is a nesting fit into recess 15 in member 12 so that as piston 60 reaches the end of its travel, it expels all fluid from member 51. The device of FIG. 1 can be used to combine the initial application of fluid from member 51 and a subsequent application of further medicament from the syringe 17. In this way a larger dose of medicament than can be achieved with either form of device on its own can be achieved.

Figure 5:
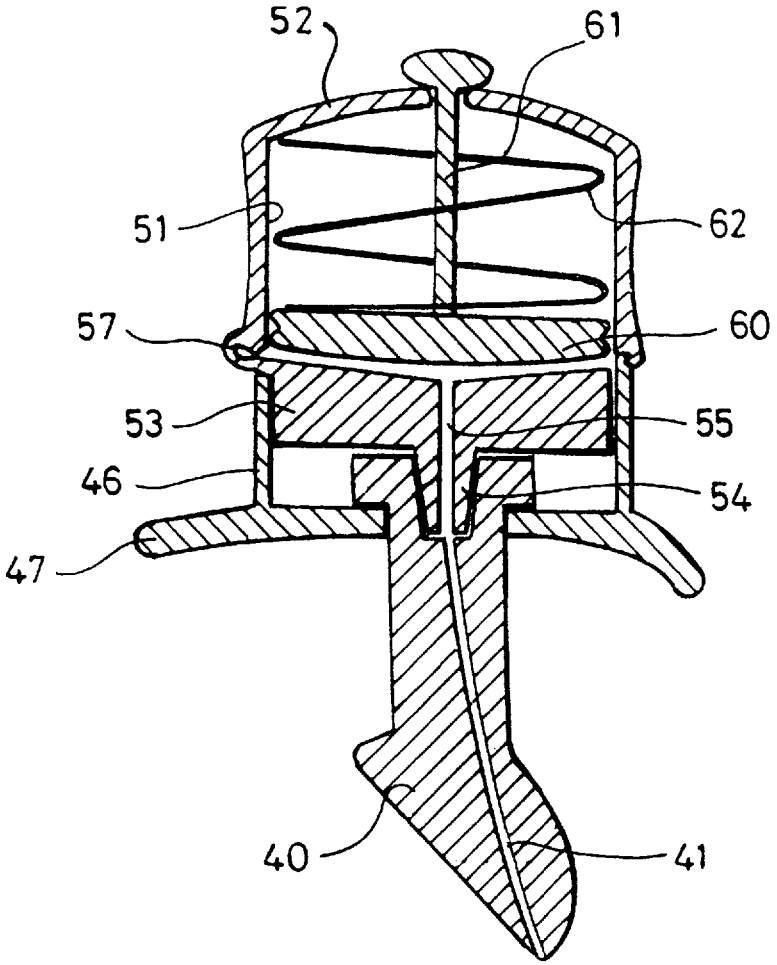
FIG. 5 shows an alternative form of the device of FIG. 4.

In an alternative form of the device as shown in FIG. 5, a compression spring 62 is located between end wall 52 and piston 60 which biases piston 60 towards member 53 so as to discharge the contents of body 51 through bores 55 and 41. The bias of the spring enables discharge of medicament to be achieved without the need for a user to apply pressure to piston 60.

Figure 6:
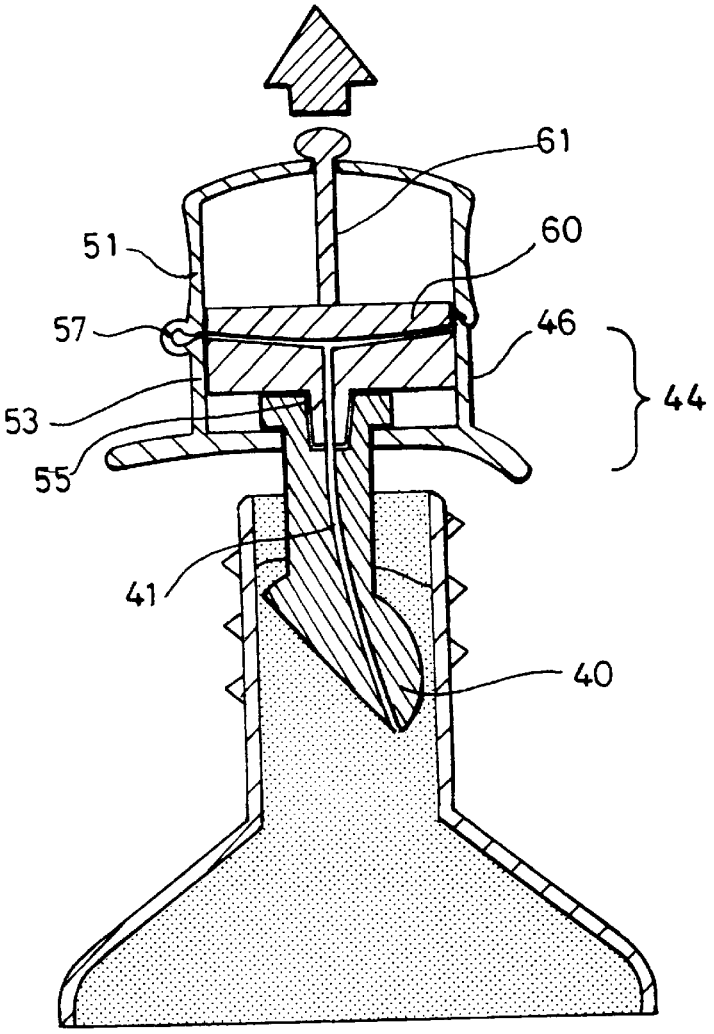
FIGS. 6, 7 and 8 shown methods of operation of the device of FIG. 4.
Figure 7:
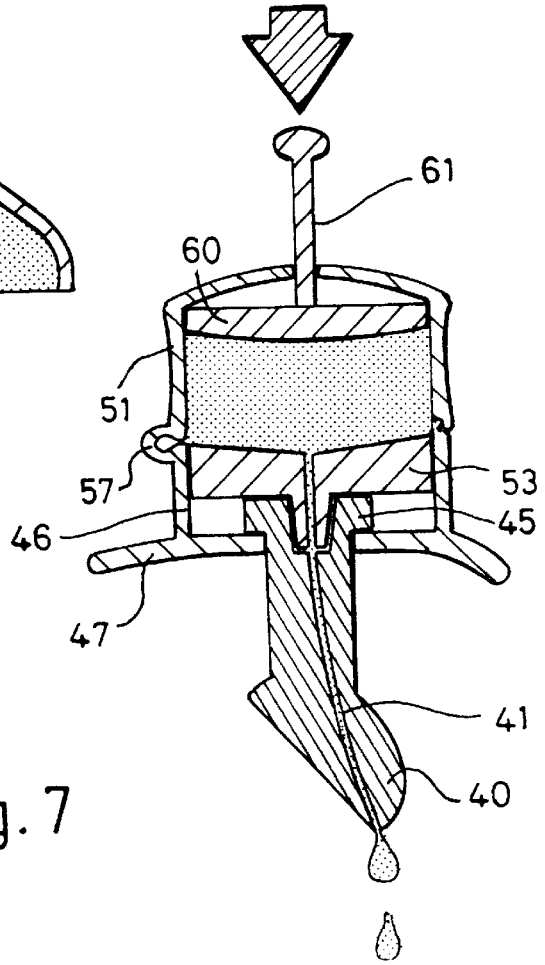

In use, the tip of teat 40 is immersed in a body of the fluid medicament as shown in FIG. 6 and piston 60 is withdrawn axially in body 51 to draw fluid up into body 51 through bores 41 and 55. Alternatively, body 51 is pivoted into the open position shown in FIG. 8 and fluid medicament poured into the exposed cavity of body 51. In either case, body 51 is charged with a desired dose of medicament. The tip of teat 40 is then inserted into the mouth of the infant and the piston 60 allowed to move axially either under the influence of spring 62 or by application of pressure on the exposed end of plunger 61 by the operator, as shown in FIG. 7; or under the influence of the suction applied to the outlet of the teat by the sucking action of the infant and the direct flow communication between the outlet of the teat and member 51. Medicament flows via bores 55 and 41 to the outlet of teat 40 from whence it is ingested by the sucking action of the infant.

In a modification of the device of FIG. 5, the diameter of the orifice at the distal end of bore 41 is sufficiently small for surface tension effects to overcome the expulsive force of spring 62 and retain the meniscus of fluid medicament at the outlet to the bore and thus prevent fluid medicament from escaping the device. When the teat is inserted into the mouth of an infant, the suction applied to the outlet by the sucking action of the infant overcomes the surface tension effects and causes fluid to flow through the outlet. In this way, a device of the invention can be charged with medicament which is not released until the infant activates the device. Furthermore, when the infant ceases sucking, the meniscus will tend to re-form at the outlet to bore 41 so that medicament ceases to flow. The device of the invention thus provides medicament only when the infant is sucking and ingests the medicament. This will reduce the risk of causing gagging by the infant due to excessive flow of medicament.

The device of the invention provides a simple and effective means for administering a wide range of fluid medicaments to infants with reduced risk of contamination and with a minimum of fluid in transit between the reservoir and the mouth of the infant. The device presents an appearance to the infant which is more acceptable than a bare syringe or spoon and makes use of the sucking action to cause ingestion of the fluid. By providing the positive pressure within the reservoir member of the device problems of contamination and incomplete dosage are minimised.

The device has been described above in terms of administration of a fluid medicament to an infant. However, the invention can be applied to the administration of a wide range of medicaments to patients of a wide range of ages, since it enables the medicament to be administered over a comparatively long period by the use of fine bore tubes in the teat. The invention can thus be applied to the administration of soothing materials to sore or inflamed throat conditions in adults or post operative medication in torisilectomy. The term medication is to be construed without limitation to fluid medicaments which are applied orally, and the term infant is to be construed as including patients of all ages.

I claim:

1. A device for administering a fluid medicament to a patient via a teat in fluid flow communication with a reservoir for the fluid medicament, characterised in that the device comprises:

a. a teat comprising a hollow bulbous member having a proximal end and a distal end, a single inlet of the bulbous member disposed at or adjacent the proximal end of the bulbous member to receive fluid from the reservoir, a single outlet of the bulbous member disposed at or adjacent the distal end of the bulbous member, such that fluid fed to the teat from the reservoir flows into the mouth of the patient through the single outlet;

b. a single tubular conduit member extending within the bulbous member and directly connecting said inlet and said outlet for the direct flow of fluid from the inlet of the bulbous member to the outlet of the bulbous member through said conduit member;

c. an intermediate member located intermediate the proximal end of the bulbous member and the reservoir and adapted to securely receive and locate the teat and to receive the reservoir; and d. a hollow reservoir member attached to said intermediate member and being in fluid flow communication via said intermediate member and said single tubular conduit member with said bulbous member outlet, said reservoir member being pivotally attached to said intermediate member whereby the interior of the hollow reservoir member can be exposed for charging with fluid.

2. A device as claimed in claim 1, characterised in that said device also comprises means for generating a positive pressure within the reservoir to assist discharge of fluid from the reservoir to the teat outlet.

3. A device as claimed in claim 1, characterised in that the tubular member is formed upon a wall of the bulbous member of said teat.

4. A device as claimed in claim 1, characterised in that the conduit has a volume which is less than 10% of the internal volume of the teat within which it is formed.

5. A device as claimed in claim 1, characterised in that the reservoir is provided with a piston member therein which is in contact with the fluid within the reservoir.

6. A device as claimed in claim 5, characterised in that the piston member is biased so as to apply a positive pressure to the fluid within the reservoir.

7. A method for administering a fluid medicament to a patient by means of the sucking action of the patient upon a teat in fluid flow communication with a reservoir containing the fluid medicament, characterised in that the device comprises:

a. a teat comprising a hollow bulbous member having a proximal end and a distal end, an inlet of the bulbous member disposed at or adjacent the proximal end of the bulbous member to receive fluid from the reservoir, an outlet of the bulbous member at or adjacent the distal end of the bulbous member, fluid fed to the teat from the reservoir flowing through the outlet into the mouth of the patient;

b. a tubular conduit member extending within the bulbous member of said teat and directly connecting said inlet to said outlet whereby fluid flows directly from the inlet of the bulbous member to the outlet of the bulbous member;

c. an intermediate member located intermediate the proximal end of the bulbous member and the reservoir for securely receiving and locating the teat and receiving the reservoir; and d. a hollow reservoir member in fluid flow communication via said intermediate member and said tubular conduit member with said bulbous member outlet, said reservoir member being pivotally attached to said intermediate member whereby the interior of the hollow reservoir member can be exposed for charging with fluid, whereby the suction generated by the sucking action of the patient on the teat of the device draws the medicament from the reservoir through the tubular conduit member and the outlet of the teat into the mouth of the patient.

8. A method as claimed in claim 7, characterised in that a positive pressure is applied to the reservoir to assist flow of medicament from the reservoir to the outlet of the teat.

* * * * *